US006252730B1

(12) United States Patent
Chabot

(10) Patent No.: US 6,252,730 B1
(45) Date of Patent: Jun. 26, 2001

(54) MIRROR MOUNTING ASSEMBLY FOR HAIR GROOMING AND STYLING

(76) Inventor: J. Roland Chabot, 91 Westbury Ct., Thousand Oaks, CA (US) 91360

( * ) Notice: Subject to any disclaimer, the term of this patent is extended or adjusted under 35 U.S.C. 154(b) by 0 days.

(21) Appl. No.: 09/185,345

(22) Filed: Nov. 3, 1998

(51) Int. Cl.[7] ..... G02B 5/08

(52) U.S. Cl. ..... 359/880; 359/881; 359/887; 359/873; 359/860

(58) Field of Search ..... 359/880, 881, 359/882, 879, 871, 872, 873, 860; 248/473, 474, 475.1, 476, 479, 489, 495

(56) References Cited

U.S. PATENT DOCUMENTS

| | | | |
|---|---|---|---|
| 52,531 | 2/1866 | Chappell | 248/495 |
| 66,168 | 6/1867 | Ober | 359/860 |
| 84,943 | 12/1868 | Furber | 359/860 |
| 176,221 | 4/1876 | Goldberg | 359/860 |
| 207,579 | 8/1878 | Wilcox | 359/860 |
| 245,091 | 8/1881 | Pattberg | 359/860 |
| 623,790 | 4/1899 | Kenyon | 359/860 |
| 661,051 | 11/1900 | Horton | 359/860 |
| 664,522 | 12/1900 | Wright | 359/854 |
| 683,549 | 10/1901 | Brentnall | 359/860 |
| 707,151 | 8/1902 | Moss | 248/480 |
| 721,944 | 3/1903 | Douglas | 248/278.1 |
| 760,478 | 5/1904 | Obermiller | 248/278.1 |
| 763,380 | 6/1904 | Martin | 248/480 |
| 878,098 | 2/1908 | Sutton | 248/283.1 |
| 1,031,075 | 7/1912 | Lundin | 403/58 |
| 1,050,321 | 1/1913 | Winzenburg | 359/860 |
| 1,395,812 | 11/1921 | Gerber | 359/854 |
| 1,577,366 | 3/1926 | Ruocco | 312/225 |
| 1,778,585 | 10/1930 | Cloud | 359/855 |
| 2,352,819 | 7/1944 | Winslow | 359/880 |
| 2,379,214 | 6/1945 | Bolinger | 359/880 |
| 2,619,008 | 11/1952 | Fuentes | 88/97 |
| 3,019,709 | 2/1962 | Teason | 88/84 |
| 3,383,082 | 5/1968 | Larson | 248/495 |
| 3,730,612 | 5/1973 | Arroyo | 350/305 |
| 3,771,854 | 11/1973 | Roark | 350/304 |
| 4,050,790 | 9/1977 | Jorwa | 350/305 |
| 4,269,382 | 5/1981 | Coulson | 248/472 |
| 4,396,249 | 8/1983 | Aisley | 350/306 |

(List continued on next page.)

*Primary Examiner*—Mohammad Y. Sikder

(57) ABSTRACT

An improved mirror mounting assembly is designed for use with an existing mirror for hair grooming and styling. The mirror assembly contains a mirror panel which is adjustable relative to an existing mirror for proper viewing. Once adjusted, the mirror angle does not normally require further adjustment since effective viewing is possible for a range of user heights. The mirror panel rotates to a protected position to prevent damage to either panel or assembly when the assembly is mounted on a door and door is opened against an adjacent wall. Similarly, mirror panel rotates to a protected position to prevent damage when the assembly is secured to a wall and an adjacent door is opened against the mirror panel. The mirror panel rotates from its protected position back to its preset viewing angle without intervention by user. The invention includes mounting and support elements which permit the assembly to be removably mounted over top edge of a door without tools. When the mirror assembly is mounted to inside of a bathroom or dressing room door, the mirror panel is available for viewing as door is closed to a position opposed to existing mirror. When the mirror assembly is mounted to outside of door, the mirror panel is available for viewing when door is opened to a position opposed to existing mirror. A modified support bracket permits securing the assembly to a wall when a door is not opposed to a fixed mirror, and the modified bracket may also be used for securing more permanently to a door. The viewer sees two images when facing mirror panel; the normal frontal image, and secondly, an image of the back, top and sides of viewer's head, thereby enabling the user to effectively observe, groom and style his or her hair.

4 Claims, 7 Drawing Sheets

U.S. PATENT DOCUMENTS

| | | | | |
|---|---|---|---|---|
| 4,531,813 | * | 7/1985 | Van den Berg | 359/871 |
| 4,707,087 | | 11/1987 | Vanzandt . | |
| 4,895,337 | * | 1/1990 | Oskam et al. | 248/487 |
| 4,930,884 | * | 6/1990 | Tichenor et al. | 359/871 |
| 5,223,984 | | 6/1993 | Schmid | 359/855 |
| 5,399,008 | | 3/1995 | Vann | 312/227 |
| 5,745,310 | * | 4/1998 | Mathieu | 359/843 |
| 5,865,415 | * | 2/1999 | Hoernig | 248/486 |
| 6,120,155 | * | 9/2000 | Brenman et al. | 359/857 |

* cited by examiner

MIRROR MOUNTING ASSEMBLY FOR HAIR GROOMING AND STYLING

BACKGROUND

1. Field of Invention

This invention relates to mirrors, specifically to an improved mounting of such mirrors when used to enable viewing front, back, top and sides of the user's head during hair grooming and styling.

2. Description of Prior Art

The need and desirability to readily view the back and top of one's head for hair grooming and for observing the back of one's clothing resulted in granting a number of U.S. patents for mirror viewing inventions for well over one hundred years. Many of the patents were granted because they enabled the user to view the back of his or her hair and clothing without the inefficiency and disadvantage of using a hand held mirror in combination with a fixed or movable mirror.

The structures and supports used to secure mirror panels and frames to furniture, ceilings, doors and walls were assemblies comprising of numerous and, in many cases, complex and expensive parts. Many were difficult to install because of their constructions and configurations. The shear size and bulk of many of these inventions would make their installations and use incompatible with many of today's bathrooms or dressing rooms.

U.S. Pat. Nos. 4,269,382 to Coulson (1981) and 4,050,790 to Jorwa (1977), with mirror panels mounted to free-standing support structures, had the potential of becoming safety hazards due to their instability and their use in areas where persons moved about. Children and adults were exposed to potential risks of injury when using the mirrors or, when not in use, having the supporting structures fall on them.

Medicine cabinets with hinged, multiple mirror panels, as in U.S. Pat. Nos. 5,399,008 to Vann (1995) and 3,771,854 to Roark (1973), were self-storing but the mirrors limited the user's movements within the room while the mirrors were extended during viewing. Mirrors mounted on a door, as in U.S. Pat. No. 3,019,709 to Teason (1962), prevented the door from being closed and one of mirrors was subject to damage if the door were opened against an adjacent wall.

Prior art inventions, such as U.S. Pat. Nos. 5,399,008 to Vann (1995), 5,223,984 to Schmid (1993) and 3,771,854 to Roark (1973), required one or more adjustments to orient or locate the mirror panel or panels to view the back and top of the user's head. After use, these inventions normally required the mirror panels to be returned to their closed or storage positions to facilitate personal movement within the room.

The mirrors and support structures of U.S. Pat. Nos. 5,223,984 to Schmid (1993), 4,269,382 to Coulson (1981) and 4,050,790 to Jorwa (1977) were subject to damage by either opening or closing an adjacent door while they were in use, unless the mirror assemblies were very carefully located and installed within a room.

OBJECTS AND ADVANTAGES

Accordingly, several objects and advantages of this improved mirror mounting assembly are:

(a) to provide a mirror mounting assembly which enables the user to readily and efficiently view front, back, top and sides of his or her head;

(b) to provide a mirror assembly which does not require the user to pull down, fold out, adjust or move mirror or mirrors prior to and after use;

(c) to provide a mirror assembly which does not require relocation to a storage position after use to facilitate movement within the room;

(d) to provide a mirror assembly with a conveniently adjustable mirror panel;

(e) to provide a mirror assembly with a mirror panel which requires no adjustments prior to viewing;

(f) to provide a mirror assembly not subject to damage due to inadvertent contact by the user;

(g) to provide a mirror assembly which is not a safety hazard, particularly to small children and infants;

(h) to provide a mirror assembly not subject to damage when opening and closing the door on which the mirror assembly is mounted;

(i) to provide a mirror assembly, secured to a wall, which is not subject to damage when opening or closing an adjacent door;

(j) to provide a mirror assembly of such size, weight, construction and configuration which may be removably mounting onto a door without using any tools;

(k) to provide a mirror assembly which is easily removed from a door for cleaning or for installation in a different room or location;

(l) to provide a mirror assembly easily secured to either a door or a wall;

Further objects and advantages are to provide a mirror mounting assembly which operates conveniently and effectively while consisting of relatively simple and inexpensive supporting and adjusting elements. Still further objects and advantages of my invention will become apparent from a consideration of the description and drawings.

DRAWING FIGURES

In the drawings, closely related figures have the same number but different alphabetic suffixes.

REFERENCE NUMERALS IN DRAWINGS

Figure 1A:
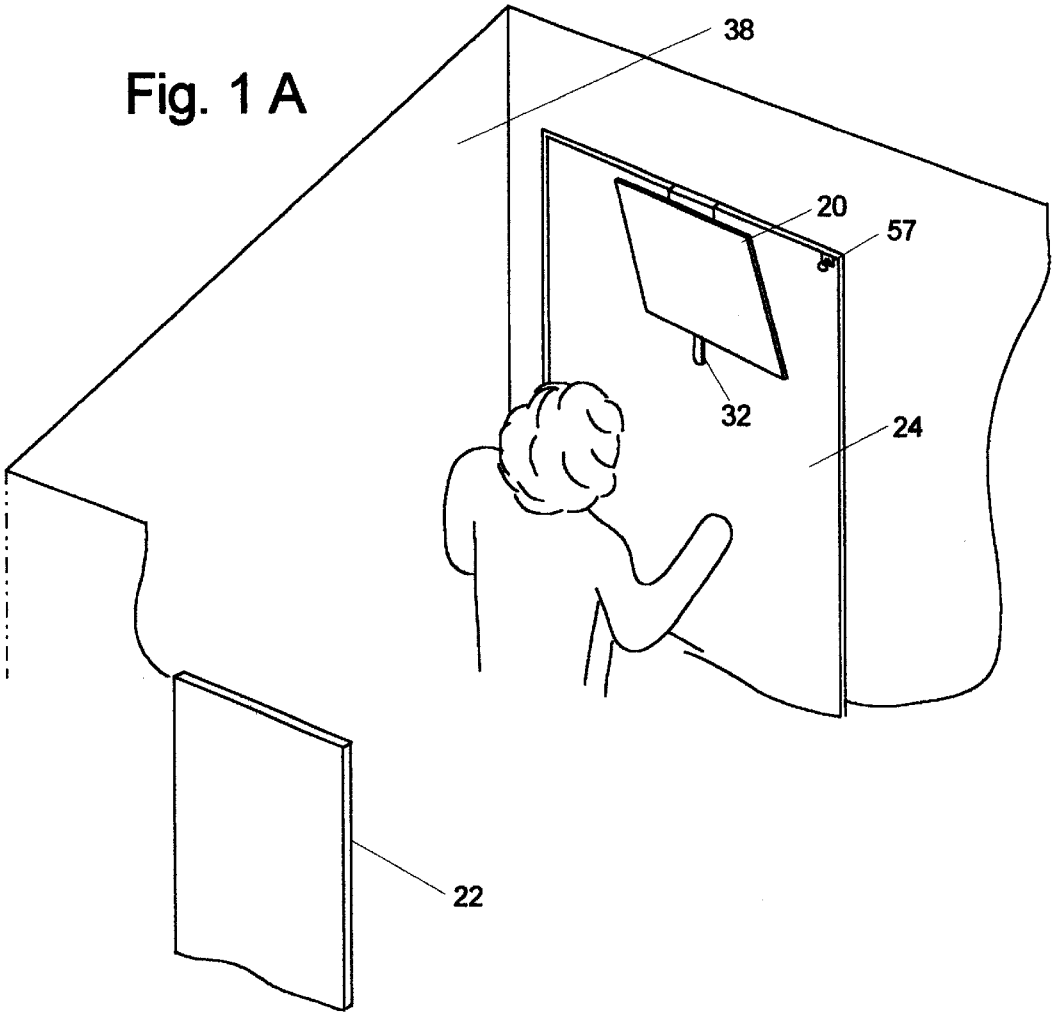
FIG. 1A is a perspective view showing mirror mounting assembly mounted on door and showing user position relative to present invention and to existing mirror.

20 mirror panel
22 existing mirror
24 door
26 support bracket
32 pivotably mounted lever
34 lever pivot
36 inclined surface
38 adjacent wall
41 lever guide
42 slidably mounted lever
44 screw
46 support bracket
52 door frame molding
54 tension element
57 door stop
58 cantilever beam
62 door
64 opposed wall
68 door frame
70 mirror panel stop
72 mounting hole

SUMMARY OF INVENTION

This mirror mounting assembly, mounted on a door or secured to a wall, and used in cooperation with an existing mirror, enables the user to readily view the front, back, top and sides of his or her head for hair styling and grooming. The initial setting of the desired viewing angle for the mirror panel is maintained after opening and closing the door to which the mirror assembly is mounted. Similarly, a one-time adjustment is required when the mirror assembly is secured to a wall and when opening and closing an adjacent door against the mirror panel. The mirror mounting assembly and its mirror panel are protected from damage for installations on a door or when secured to a wall. The mirror mounting assembly provides a convenient, protected, self-storing, safe and non-complex mirror panel for hair grooming and styling.

DESCRIPTION AND OPERATION OF INVENTION

Description—FIGS. 1A to 3D

Figure 1B:
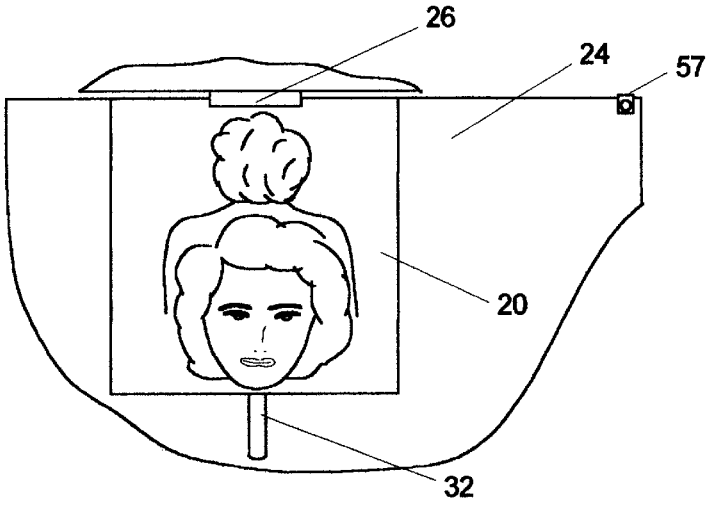
FIG. 1B is an enlarged view of mirror panel showing facial image and back image of user.
Figure 2A:
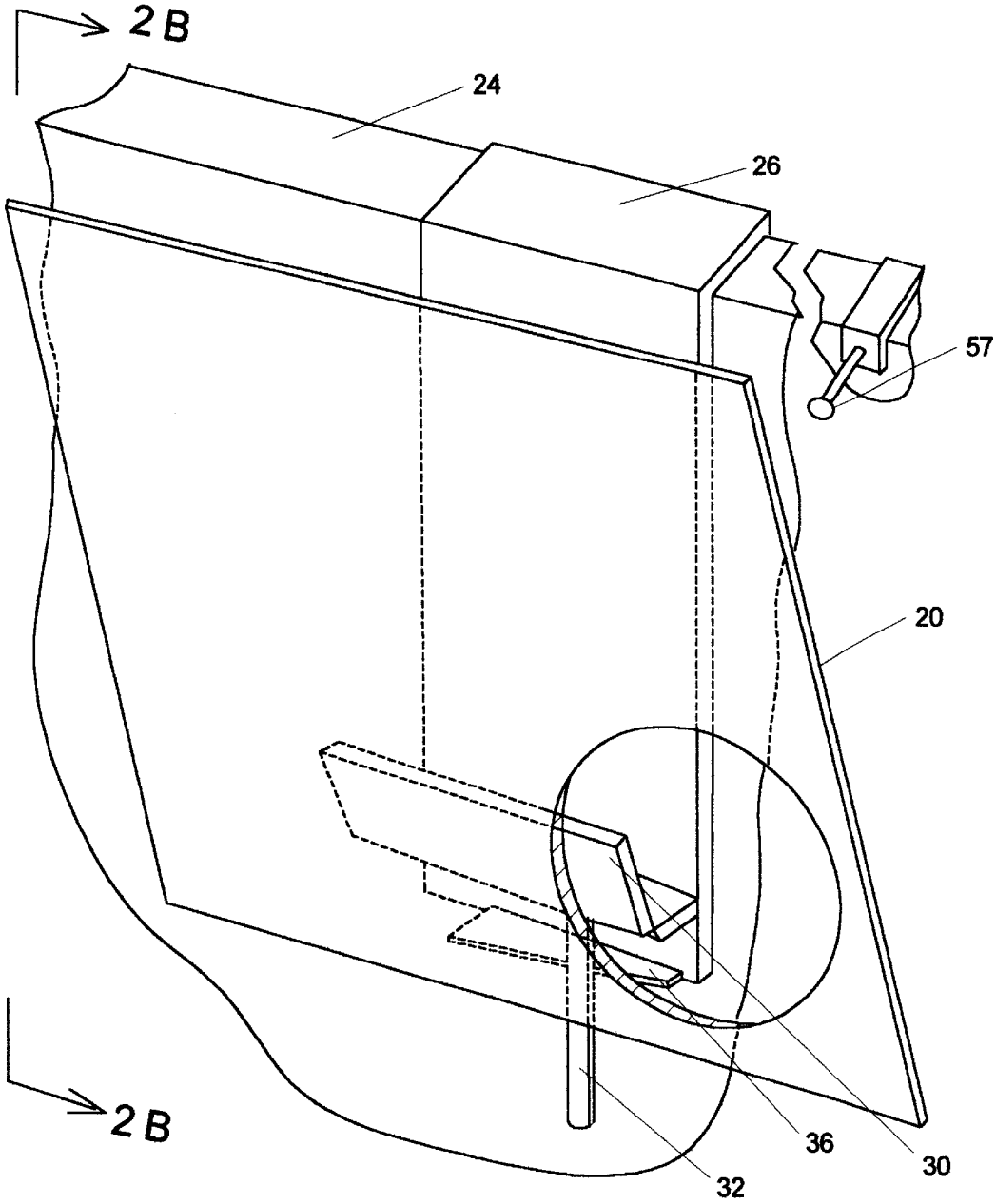
FIG. 2A is a perspective view of mirror assembly mounted on door, with mirror panel partially removed for clarity, showing mounting, supporting and adjusting elements for mirror panel.
Figure 2B:
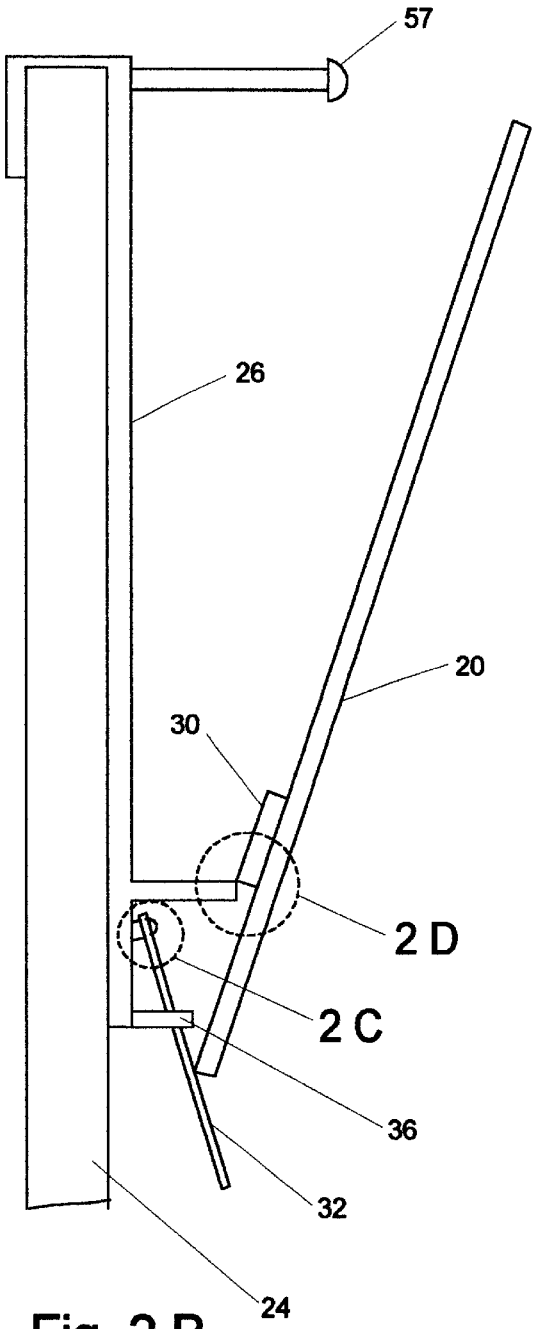
FIG. 2B is a side view with mirror panel in viewing position.
Figure 2C:
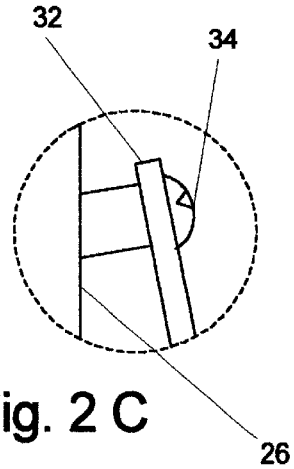
FIG. 2C is an enlarged view of lever pivot for pivotably mounted lever.
Figure 2D:
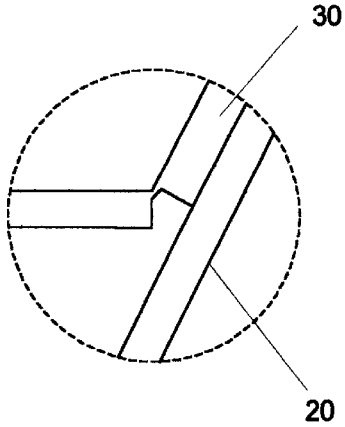
FIG. 2D is an enlarged view of hingable support attached to rear surface of mirror panel.
Figure 3A:
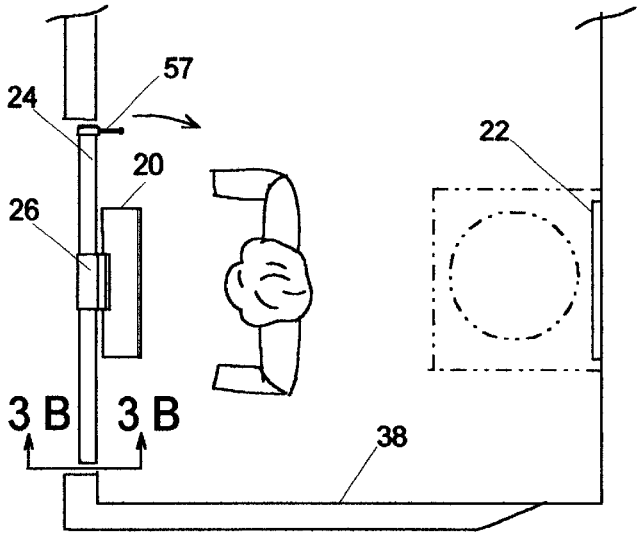
FIG. 3A is a top plan view showing position of user viewing her image in mirror assembly mounted on door which, when closed, is opposed to existing mirror.
Figure 3B:
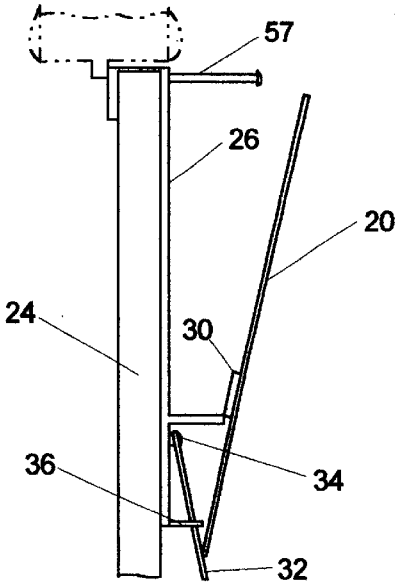
FIG. 3B is a side view, at an enlarged scale, showing mirror panel in viewing position when door is closed.
Figure 3C:
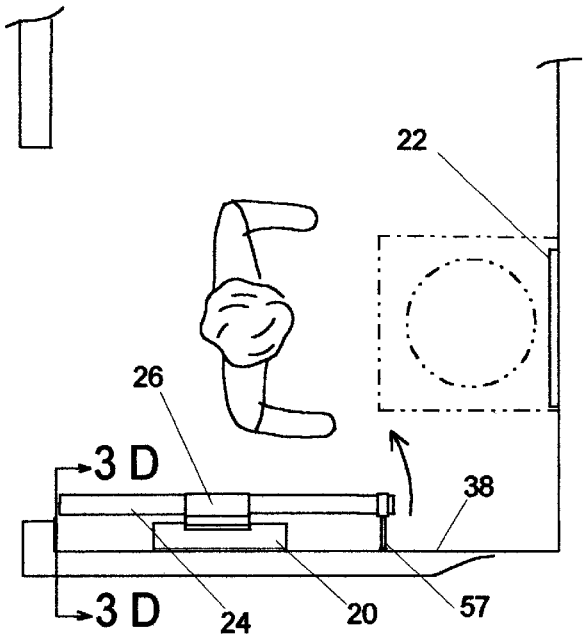
FIG. 3C is a top plan view showing mirror assembly with door open against adjacent wall.

The preferred embodiment of the mirror mounting assembly, mounted on the inside of a door 24, is shown in FIGS. 1A and 2A (perspective views). FIG. 1B illustrates the two images viewer sees in a mirror panel 20. FIGS. 2A and 2B show a support bracket 26 and a door stop 57 mounted on door 24 and show a hingable support 30 and an inclined plane 36 attached to bracket 26. FIG. 2C illustrates attachment of a lever pivot 34 to bracket 26 and securing a pivotably mounted lever 32 to bracket 26. FIG. 2D shows an enlarged view of hingable support 30 attached to panel 20. FIG. 3A (top plan view) shows mirror assembly mounted on door 24, which opens in direction shown by arrow, and shows position of user relative to mirror mounting assembly and her position relative to an existing mirror 22. FIG. 3B (side view) illustrates mirror panel 20 in viewing position with its rear surface contacting lever 32. FIG. 3C (top plan view) illustrates mirror assembly mounted to door 24 which is open against an adjacent wall 38. Mirror panel 20 is shown rotated to its protected, near-vertical position in FIG. 3D (side view). Contact between lever 32 and inclined surface 36 is maintained by lever pivot 34.

Operation—FIGS. 1A to 3D

The user views front, back, top and sides of her head in mirror panel 20, adjusted to a desired viewing angle, by standing between mirror panel 20 and existing mirror 22 as shown in FIGS. 1A and 3A. Two images appear in mirror panel 20 as illustrated in FIG. 1B, a facial image and a smaller image of the back of the head and portions of the user's back. Support bracket 26 is constructed to permit installing mirror assembly on door 24 as shown in FIG. 2A without using tools. The shape of top portion of bracket 26 permits engagement over top edge of door 24 to support mirror assembly. Similarly, door stop 57 slips onto door 24 without using tools. Hingable support 30 permits mirror panel 20 to rotate freely from its own weight about bracket 26 until rear surface of panel 20 makes contact with lower portion of lever 32 as illustrated in FIG. 2B. Viewing angle of mirror panel 20 is adjusted by moving pivotably mounted lever 32. The lower portion of lever 32 is moved toward or away from door 24 by inclined surface 36 when lever 32 is rotated about lever pivot 34. In FIG. 2A, rotation of lever 32 to the left moves lower portion of lever 32 away from door 24, thus urging bottom of panel 20 away from door 24. Rotation of lever 32 to the right moves lever 32 toward door 24, thus allowing top of panel 20 to rotate from its own weight, away from door 24, until rear surface of panel 20 is stopped by contact with lever 32. Lever pivot 34 is constructed to maintain the adjusted position of lever 32 when mirror panel 20 is not in contact with lever 32.

Figure 3D:
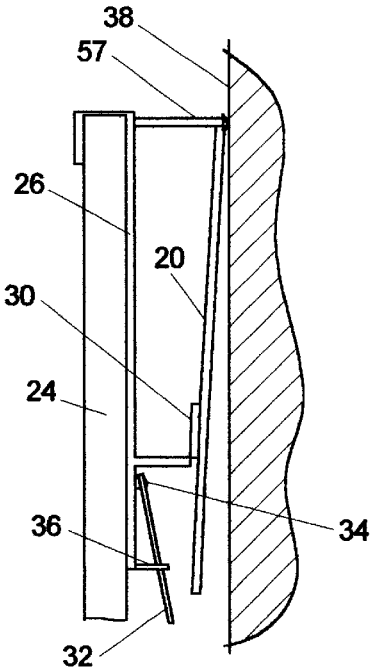
FIG. 3D is a side view, at an enlarged scale, showing mirror panel contacting adjacent wall and panel in its protected position when door is open against adjacent wall.

FIGS. 3C and 3D illustrate how mirror panel 20 is protected from damage when door 24, which provides access into room, is opened against adjacent wall 38. When door 24 is opened and approaches adjacent wall 38, front surface of mirror panel 20 makes initial contact with wall 38. Once contact is made, further opening door 24 results in a force from wall 38 which urges mirror panel 20 to rotate until it reaches its near-vertical, protected position, illustrated in FIG. 3D. Door stop 57 maintains a predetermined distance between door 24 and adjacent wall 38, thus preventing damage to mirror panel 20 and mirror mounting assembly, as illustrated in FIG. 3D. As door 24 closes and moves away from adjacent wall 38, mirror panel 20 freely rotates to its preset viewing angle when panel 20 contacts lever 32 shown in FIG. 3B.

Viewing reflections in mirror panel 20, the user is able to observe two images as shown in FIG. 1B. The first image is of the front of the viewer's face and hair. The second, smaller image is of back and top of the viewer's head . Side views are observed by slight side-to-side rotation of user's head. In combination, these images enable user to readily observe front, back, top and sides of his or her head during hair grooming and styling.

Alternatively, user may face existing mirror 22, and observe frontal image normally seen in mirror 22, and concurrently view image of back and top of his or head from mirror panel 20 reflected to existing mirror 22.

Description—FIGS. 7A to 7E

Figure 7A:
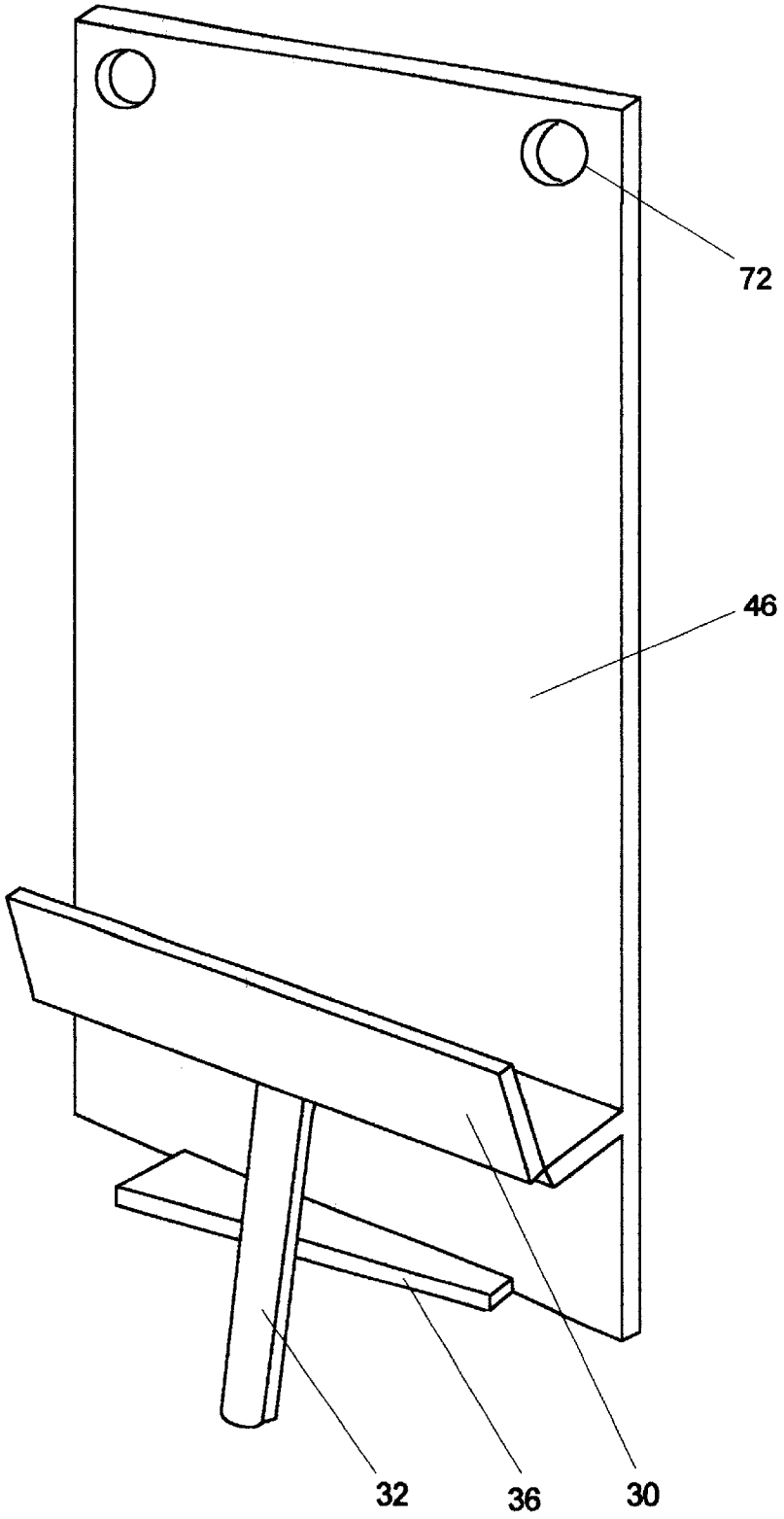
FIG. 7A is a perspective view, with mirror panel and hingable support partially removed for clarity, showing slidably mounted lever used to adjust viewing angle.
Figure 7B:
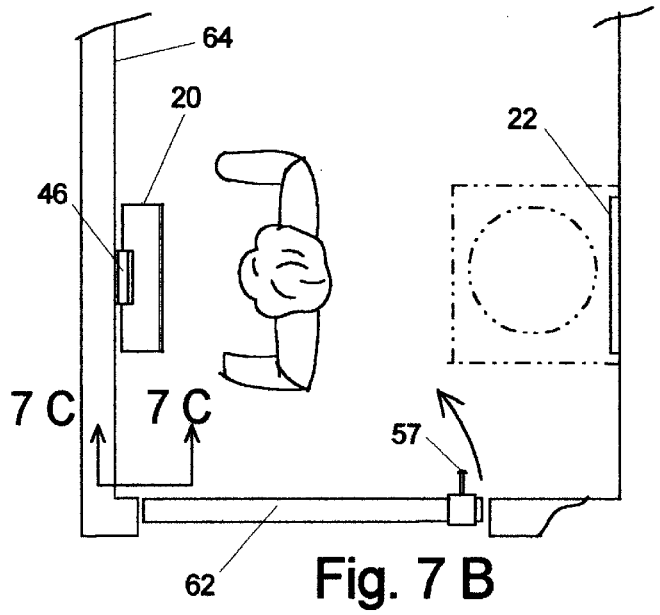
FIG. 7B is a top plan view showing position of user viewing her image in mirror assembly mounted to wall opposed to existing mirror.
Figure 7C:
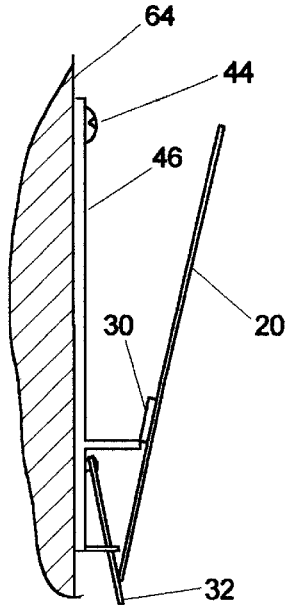
FIG. 7C is a side view, at an enlarged scale, showing mirror panel in viewing position.
Figure 7D:
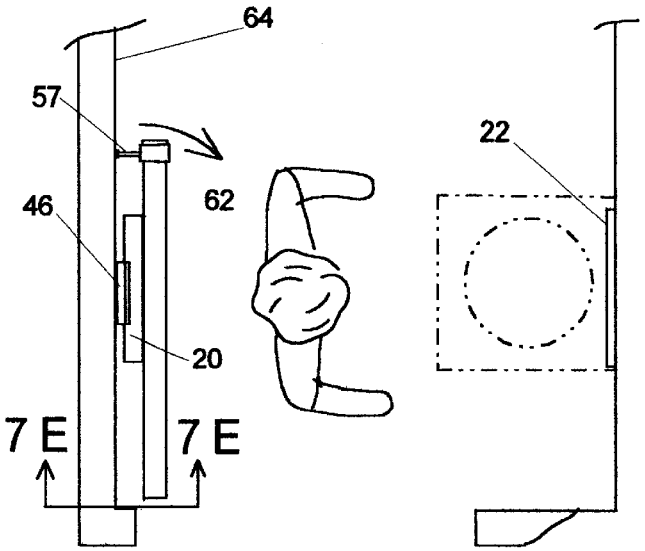
FIG. 7D is a top plan view showing door open against mirror assembly mounted on wall.
Figure 7E:
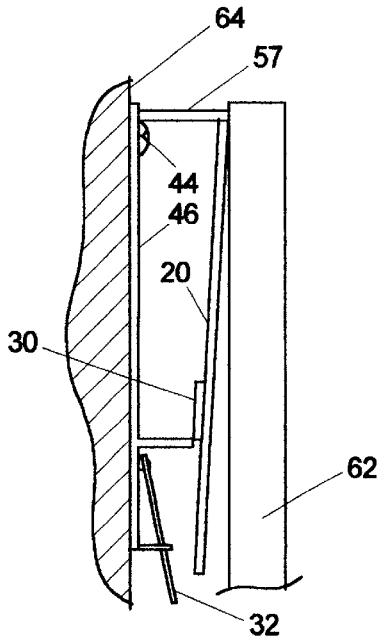
FIG. 7E is a side view, at an enlarged scale, showing mirror panel in its protected position when door is open against mirror assembly.

FIG. 7A (perspective view with mirror panel 20 removed) illustrates a support bracket 46 used for a more permanent mounting of the mirror assembly. Bracket 46 may be used to secure mirror assembly to a wall or to a door. In this description, bracket 46 secures mirror assembly to a wall 64 when wall 64 is opposed to existing mirror 22 as shown in FIG. 7B (top plan view). Bracket 46 includes a mounting hole 72 for securing to wall 64 using a screw 44, as shown in FIG. 7C (side view). Hingable support 30 is joined to bracket 46. Mirror panel 20, lever 32, pivot 34, inclined surface 36 and door stop 57 are identical to those used in previously described embodiments. FIG. 7B shows mirror assembly mounted on wall 64 and shows position of user relative to mirror assembly and relative to existing mirror 22. FIG. 7C shows mirror panel 20 in viewing position. FIG. 7D (top plan view) shows door 62 open against wall 64. FIG. 7E (side view) illustrates mirror panel 20 in its protected, near-vertical position when door 62 is closed against wall 64.

Operation—FIG. 7A to 7E

FIG. 7A illustrates support bracket 46 with the holes 72 for securing to wall 64 using screw 44. When door 62 is opened in direction of arrow shown in FIG. 7B, to provide access into room, door 62 makes initial contact with front surface of panel 20. Once contact is made, further opening door 62 provides a force which urges panel 20 to rotate until it reaches its near-vertical, protected position, illustrated in FIG. 7E. As door 62 moves away from wall 64, mirror panel 20 rotates from its own weight to its preset viewing angle, determined by position of lever 32. Operation of this embodiment is seen to be nearly identical to preferred embodiment except that support bracket 46 is used to attach to a wall in this embodiment, whereas support bracket 26 is used to mount on a door in preferred embodiment.

Description—FIG. 8A to 8D

Figure 8A:
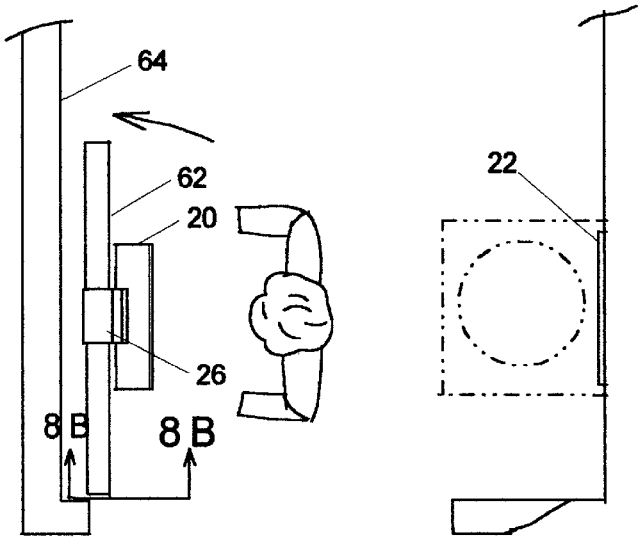
FIG. 8A is a top plan view showing position of user viewing her image in mirror assembly mounted on door which, when open into room, is opposed to existing mirror.
Figure 8B:
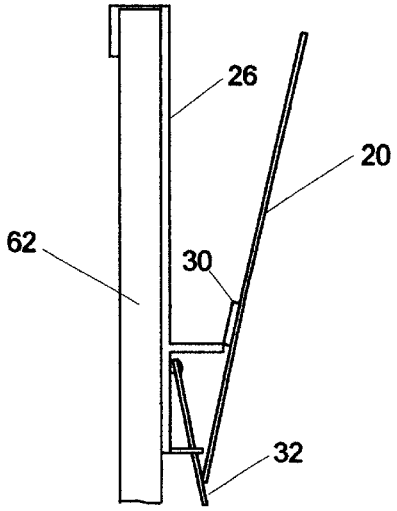
FIG. 8B is a side view, at an enlarged scale, showing mirror panel in viewing position.
Figure 8C:
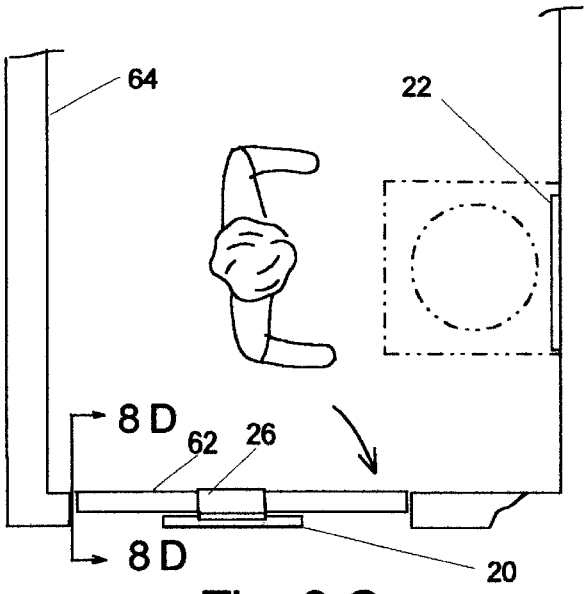
FIG. 8C is a top plan view showing door in closed position.
Figure 8D:
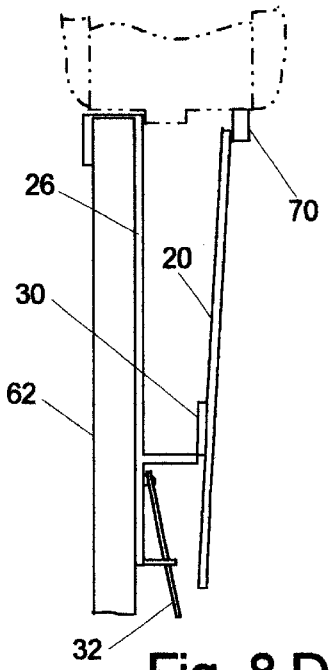
FIG. 8D is a side view, at an enlarged scale, showing mirror panel protected within door frame when door is closed.

This embodiment may use any of the mirror assemblies described in FIG. 2A, FIG. 5A or FIG. 7A. FIGS. 8A to 8D illustrate the use of mirror assembly of FIG. 2B. Door stop 57 is not required since distance between door 62 and wall 64 does not need to be controlled for this embodiment. Installation of mirror assembly for this embodiment is on outside of door 62, as shown in FIGS. 8A and 8C (top plan views). FIG. 8A illustrates position of user relative to mirror assembly and relative to existing mirror 22 when door 62 is open. FIG. 8B shows panel 20 in viewing position when door 62 is open. FIG. 8C (top plan view)shows door 62 in closed position. A mirror panel stop 70, attached to a door frame, is shown in contact with panel 20 in FIG. 8D (side view).

Operation—FIG. 8A to 8D

Operation of this embodiment, illustrated in FIGS. 8A to 8D, is nearly identical to operation of preferred embodiment described in FIGS. 1A to 3D. FIG. 8A illustrates mirror assembly in viewing position with door open. Mirror panel 20 is at preset viewing angle with panel 20 in contact with lever 32 as shown in FIG. 8B. This embodiment includes mirror panel stop 70 which acts to prevent panel 20 from protruding beyond door frame, illustrated in FIG. 8D. As door 62 is moved into door frame 68 (direction of arrow in FIG. 8C), panel 20 contacts stop 70, thus forcing panel 20 to rotate from preset viewing angle to protected position shown in FIG. 8D. The protection of panel 20, provided by door frame 68, effectively reduces the probability of contact by movement of objects and people in proximity of closed door 62.

SUMMARY, RAMIFICATIONS, AND SCOPE

Accordingly, the reader will see that the mirror mounting assembly is an effective, convenient, protected, self-storing, safe and non-complex device which enables the user to readily view the front, back, top and sides of his or her head for hair grooming and styling. Furthermore, the mirror mounting assembly has the following additional advantages:

- it provides features for preventing damage to the mirror panel when mounted on a door or when secured to a wall;
- it provides a convenient method of setting and maintaining the desired viewing angle of mirror panel for initial installation and, when necessary, to readily adjust the viewing angle for users of widely varying heights;
- it readily mounts on top edge of a door without using tools and is easily removed from door for cleaning or for installation in a different room or location.

While my above description contains many specificities, these should not be construed as limitations on the scope of the invention, but rather as an exemplification of the preferred and alternate embodiments thereof. Many other variations are possible. For example, the adjusting lever may have other configurations; the mirror panel may have other shapes such as round, oval, etc.; the mirror panel may be framed or not framed, may be standard glass, plastic or polished metal; materials for various elements may be plastic, metal or a combination of the two; the hingable support may include a hinge made of plastic, of metal or of a combination thereof; the tension element and cantilever beam may be metal or plastic members or a combination thereof; other methods of securing the mirror assembly to a door or wall may be used, such as adhesives, nails, anchoring bolts, etc.; the mirror panel stop is shown as a block of material bonded to the door frame but may be a threaded member screwed into door frame; the door stop illustrated slips over top of door but a standard door stop may be used; the support bracket may be one piece or modular construction.

Accordingly, the scope of the invention should be determined not by the embodiments illustrated, but by the claims and their legal equivalents.

I claim:

1. A mirror mounting assembly for hair grooming and styling, used cooperatively with existing mirror, said existing mirror having an opposed mounting surface for securing the mirror assembly, comprising:

(a) a mirror panel having a front reflecting surface and a rear surface, (b) a hingable support with means for attaching to said rear surface and to a support bracket, (c) said support bracket having mounting means for securing the mirror assembly to said opposed mounting surface, (d) means for adjusting a desired viewing angle comprising a lever and an inclined plane, said hingable support permitting the panel to rotate to a near-vertical position when a force is applied to top portion of said front reflecting surface and permitting the panel to rotate freely until said rear surface of the panel makes contact with said lever and returns to said desired viewing angle when said force is removed, wherein said lever contacting said rear surface adjustably sets and maintains the panel to the viewing angle, and said inclined plane acting cooperatively to force said lever either inwardly or outwardly relative to said mounting surface, when said lever is rotated along said inclined plain, and said lever urging the panel to rotate when said lever is forced outwardly, and permitting the panel to rotate freely when said lever is forced inwardly, wherein the user readily views front, back, top, and sides of his or her hair in said mirror panel for hair grooming and styling.

2. The mirror mounting assembly of claim 1 wherein said support bracket includes attaching means for removably mounting the mirror assembly, without requiring tools, over top edge of a door when said door is opposed by said existing mirror.

3. The mirror mounting assembly of claim 1 wherein said lever is a pivotably mounted lever.

4. The mirror mounting assembly of claim 3 wherein said support bracket includes attaching means for removably mounting the mirror assembly, without requiring tools, over top edge of a door when said door is opposed by said existing mirror.

* * * * *